US006907203B2

(12) United States Patent
Lee

(10) Patent No.: US 6,907,203 B2
(45) Date of Patent: Jun. 14, 2005

(54) METHOD OF CONTROLLING A FUSING TEMPERATURE OF AN ELECTROPHOTOGRAPHIC IMAGING APPARATUS

(75) Inventor: Beom-ro Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 77 days.

(21) Appl. No.: 10/667,608

(22) Filed: Sep. 23, 2003

(65) Prior Publication Data

US 2004/0165903 A1 Aug. 26, 2004

(30) Foreign Application Priority Data

Oct. 12, 2002 (KR) ..... 10-2002-0062255

(51) Int. Cl.[7] ..... G03G 15/20
(52) U.S. Cl. ..... 399/69; 399/67
(58) Field of Search ..... 399/33, 38, 67, 399/69, 70; 219/216, 485, 486, 492, 501, 506, 619

(56) References Cited

U.S. PATENT DOCUMENTS 5,671,462 A * 9/1997 Toyohara et al. ..... 399/33
5,801,360 A * 9/1998 Oba et al. ..... 219/216
6,185,388 B1 * 2/2001 Yamamoto ..... 399/69
6,778,789 B2 * 8/2004 Cho et al. ..... 399/69

* cited by examiner

*Primary Examiner*—Hoan Tran
(74) *Attorney, Agent, or Firm*—Stanzione & Kim, LLP

(57) ABSTRACT

A method of controlling a fusing temperature of an electrophotographic imaging apparatus includes controlling the fusing temperature of a fusing roller which is subject to a delayed response to heating due to a rubber layer formed on a surface of the fusing roller with a predetermined thickness. In the method, after the fusing temperature of the fusing roller has reached a predetermined target fusing temperature, a power corresponding to an offset value or an offset power supply ratio is supplied to a heater for a predetermined power control period or a predetermined offset control period to maintain the fusing temperature of the fusing roller. A thermal loss in the fusing apparatus during a print mode is compensated by existing power control methods, and the fusing temperature of the fusing roller is maintained at the target fusing temperature by periodically supplying a predetermined amount of the power to the heater, so that a quality of an image fused onto a recording medium is improved.

22 Claims, 9 Drawing Sheets

METHOD OF CONTROLLING A FUSING TEMPERATURE OF AN ELECTROPHOTOGRAPHIC IMAGING APPARATUS

CROSS-REFERENCE TO RELATED APPLICATIONS

This application claims the benefit of Korean Patent Application No. 2002-62255 filed with the Korea Industrial Property Office on Oct. 12, 2002, the disclosure of which is incorporated herein by reference.

BACKGROUND OF THE INVENTION

1. Field of the Invention

The present invention relates to a method of controlling a fusing temperature of an electrophotographic imaging apparatus, such as a printer, a copy machine, or a facsimile, and more particularly, to a method of controlling a fusing temperature of a fusing apparatus having a rubber layer thereon.

2. Description of the Related Art

Electrophotographic imaging apparatuses include a fusing apparatus that heats a sheet of paper to which a toner image is transferred, to instantaneously fuse and fix the toner image on the paper. The fusing apparatus includes a fusing roller that is heated to fuse the toner image on the paper, and a pressing roller that pushes the paper against the fusing roller to tightly support the fusing roller while the paper is fed therebetween.

FIG. 1 is a cross-sectional view of a conventional fusing roller 10 in which a halogen lamp (heater) 12 is installed as a heating source. FIG. 2 is a cross-sectional view of a fusing apparatus provided with the fusing roller 10 of FIG. 1.

Referring to FIG. 1, the fusing roller 10 includes a cylindrical roller 11 and the halogen lamp 12 installed at a core of the roller 11. A toner-releasing coating layer 11*a* made of Teflon is formed on a surface of the roller 11. The halogen lamp 12 generates heat to heat the fusing roller 10.

Referring to FIG. 2, a pressing roller 13 is positioned below the fusing roller 10, and a sheet of paper 14 is fed between the pressing roller 13 and the fusing roller 10. The pressing roller 13 is elastically supported by a spring 13*a* to contact the fusing roller 10 and to apply a predetermined pressure to push the paper 14 toward the fusing roller 11. While the paper 14 to which an unstable toner image has been transferred passes between the fusing roller 10 and the pressing roller 13, the toner image formed of toner particles 14*a* is fused onto the paper 14 by pressure and heat.

A thermistor 15 that measures a surface (fusing) temperature of the fusing roller 11, and a thermostat 16 that cuts off a power supply to the halogen lamp 12 from an external power source when the surface temperature of the fusing roller 10 exceeds a predetermined set value, are installed adjacent to the fusing roller 10. The thermistor 15 measures the surface temperature of the fusing roller 10 to transmit an electrical signal corresponding to the measured surface temperature to a controller (not shown) of a printer (not shown). The controller controls the external power source to supply the power supply to the halogen lamp 12 based on the measured temperature to keep the surface temperature of the fusing roller 10 within a given range. When the measured temperature of the fusing roller 10 exceeds the predetermined set value as a result of failure in a temperature control by the thermistor 15 and the controller, a contact (not shown) of the thermostat 16 becomes open to cut off the power supply supplied to the halogen lamp 12 from the external power source.

In the above-described fusing roller 10 having the halogen lamp 12 as the heating source, only the toner-releasing coating layer 11*a* having a thickness of 20–30 $\mu$m is formed on the cylindrical roller 11. Accordingly, there is rarely a difference in surface temperatures between the roller 11 and the toner-releasing coating layer 11*a*, so that the surface temperature of the fusing roller 10 can be measured from the toner image-releasing coating layer 11*a* to control the external power source or the halogen lamp 12 to supply the power supply to the halogen lamp 12 by an on-off control.

FIG. 3 is a flowchart showing the on-off control of the fusing apparatus in the electrophotographic imaging apparatus. Referring to FIGS. 2 and 3, the surface temperature of the fusing roller 10 is measured at a predetermined interval, for example, at 100 ms in operation 40.

The measured temperature of the fusing roller 10 is compared with a target fusing temperature in operation 42. If the measured temperature of the fusing roller 10 is lower than the target fusing temperature, the halogen lamp 12 is turned onin operation 44. If the measured temperature of the fusing roller 10 is higher than or equal to the target fusing temperature, the halogen lamp 12 is turned off in operation 46. After operation 44 or 46, operation 40 of measuring the surface temperature of the fusing roller 10 is repeated. In other words, a temperature of the fusing roller 10 can be simply controlled to be constant by measuring the surface temperature at intervals and controlling the halogen lamp 12 or the external power source to supply the power supply to the halogen lamp 12 by the on-off control.

However, the fusing apparatus used in a high-speed printer capable of printing 25 sheets of paper a minute or in a color printer requires a greater fusing nip between the fusing roller 10 and the pressing roller 13 to obtain a longer fusing duration and a higher fusing efficiency. To this end, a method of disposing a rubber layer having a predetermined thickness between the toner-releasing coating layer 11*a* and the cylindrical roller 11 of the fusing roller 10 has been suggested.

Referring to FIG. 4, a fusing roller 50 includes a cylindrical roller 51 and a halogen lamp 52 installed at the core of the cylindrical roller 51. The cylindrical roller 51 is formed of aluminum with a thickness of 1.5 mm, a rubber layer 53 having a thickness of 1.5 mm is formed on the cylindrical roller 51, and a Teflon coating layer 53*a* having a thickness of 20–30 $\mu$m is formed on the rubber layer 53. The halogen lamp 52 generates the heat in the cylindrical roller 51, and the cylindrical roller 51 is heated by the heat radiated from the halogen lamp 52 and transfers the heat to the rubber layer 53 and the coating layer 53*a*.

FIG. 5 is a graph of temperature profiles with respect to time at various positions in a radial direction of the fusing roller 50 when a predetermined power is supplied to the halogen lamp 52 of the fusing roller 50 of FIG. 4. Referring to FIG. 5, in the cylindrical roller 51 having a thickness ranging from a radial distance of 13 mm, which is measured from a core (center) of the fusing roller 50 in a radial direction, to 14.5 mm, i.e., an outer circumference of the cylindrical roller 51, the temperature of the cylindrical roller 51 is constant throughout its thickness when being heated and measured because of a high thermal conductivity of the cylindrical roller 51 made of aluminum.

In the rubber layer 53 having a thickness ranging from the radial distance of 14.5 mm to 16 mm, the measured temperature of the rubber layer 53 tends to drop greatly with the increase of the radial distance from the core of the cylindrical roller 51. This is because the thermal conductivity of the rubber layer 53 is so low that a heat transfer rate (speed) from the cylindrical roller 51 to a surface of the rubber layer 53 is very slow. For example, for a heating duration of 90 seconds, the temperature of the cylindrical roller 51 reaches 230° C. due to a thickness of the rubber layer 53 while the surface temperature of the fusing roller 50 is as low as 180° C.

When a temperature control to the fusing roller 50 having the thick rubber layer 53 is performed by a general on-off control method, the following problems occur. When the surface temperature of the fusing roller 50 reaches the target temperature, for example, 180° C., the temperature of the cylindrical roller 51 is 230° C. If the halogen lamp 52 is turned off at this time, the temperature of the cylindrical roller 51 immediately drops while the surface temperature of the rubber layer 53 continues to rise when the cylindrical roller 51 has a higher temperature than that of the rubber layer 53. As a result, the surface temperature of the fusing roller 50 rises above the target fusing temperature.

When the surface temperature of the fusing roller 50 is lower than the target fusing temperature in a print mode, the halogen lamp 52 is turned on to heat the fusing roller 50. At this time, if the surface temperature of the fusing roller 50 is maintained below the target fusing temperature during the printing mode, the temperature of the cylindrical roller 51 may increase to a certain temperature—higher than the target temperature. As a result, the rubber layer 53 may be thermally deformed.

Furthermore, since a power control period is too short according to this method, the halogen lamp 52 must be turned on and off frequently, thereby causing flicker problems.

SUMMARY OF THE INVENTION

The present invention provides a method of controlling a fusing temperature of a fusing roller having a thick rubber layer in an electrophotographic imaging apparatus to improve a quality of an image fused onto a recording medium by minimizing deviation of a surface temperature of the fusing roller and by increasing a control period of a power supplied to a heater of the fusing roller.

In accordance with an aspect of the present invention, there is provided a method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising: determining whether a predetermined new power control period starts; if the new power control period starts, calculating a power supply ratio corresponding to a power to be supplied to the heater during the new power control period with respect to a maximum power that can be supplied to the heater; if the calculated power supply ratio is greater than zero, supplying the power corresponding to the power supply ratio to the heater during the new power control period; and if the calculated power supply ratio is not greater than zero, repeating the above operations, wherein the power supply ratio is calculated by adding a predetermined offset value $\beta$ to a control value that is a product of a predetermined coefficient $\alpha$ and a subtraction of a measured temperature of the fusing roller from a target fusing temperature. The offset value $\beta$ is smaller than or equal to a ratio of a power supply with respect to the maximum power that is supplied to the heater for the new power control period to maintain the measured temperature of the fusing roller at the target fusing temperature when the measured temperature is around the target fusing temperature.

In the above method, the offset value $\beta$ may be determined according to the target fusing temperature of the fusing roller. The coefficient $\alpha$ may be determined according to at least one of a quality of a sheet of paper, a printing speed, and whether a printing mode is color printing. The supplying of the power corresponding to the power supply ratio to the heater during the new power control period may be performed according to a duty control.

The present invention provides another method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising: determining whether a predetermined new power control period starts; if the new power control period starts, determining whether a measured temperature of the fusing roller is lower than a target fusing temperature; if the measured temperature is lower than the target fusing temperature, calculating a power supply ratio corresponding to a power to be supplied to the heater during the new power control period with respect to a maximum power that can be supplied to the heater; supplying the power corresponding to the power supply ratio to the heater during the new power control period; if the new power control period does not start yet or if the measured temperature is not lower than the target fusing temperature, determining whether a predetermined new offset control period starts; and if the new offset control period starts, calculating an offset power supply ratio corresponding to the power to be supplied to the heater during the new offset control period and supplying the power corresponding to the calculated offset power supply ratio to the heater.

The present invention also provides another method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising: determining whether a predetermined new power control period starts; if the new power control period starts, calculating a power supply ratio corresponding to a power to be supplied to the heater during the new power control period with respect to a maximum power that can be supplied to the heater; determining whether the calculated power supply ratio is greater than zero; if the calculated power supply ratio is greater than zero, supplying the power corresponding to the power supply ratio to the heater during the new power control period; if the new power control period does not start yet or if the calculated power supply ratio is smaller than or equal to zero, determining whether a predetermined new offset control period starts; and if the new offset control period starts, calculating an offset power supply ratio corresponding to the power to be supplied to the heater during the new offset control period and supplying the power corresponding to the calculated offset power supply ratio to the heater.

The present invention also provides another method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising: determining whether a predetermined new power control period starts; if the new power control period starts, determining whether a measured temperature of the fusing roller is lower than a target fusing temperature; turning on the heater during the new power control period if the measured temperature is lower than the target fusing temperature and turning off the heater during the new power control period if the measured temperature is greater than or equal to the target fusing temperature; if the new power control period does not start yet, determining whether a predetermined new offset control period starts; and if the new offset control periodstarts, calculating an offset power supply ratio corresponding to a power to be supplied to the heater during the new offset control period and supplying the power corresponding to the calculated offset power supply ratio to the heater.

BRIEF DESCRIPTION OF THE DRAWINGS

The above and/or other features and advantages of the present invention will become more apparent by describing in detail exemplary embodiments thereof with reference to the attached drawings in which.

DETAILED DESCRIPTION OF THE PREFERRED EMBODIMENTS

Figure 1:
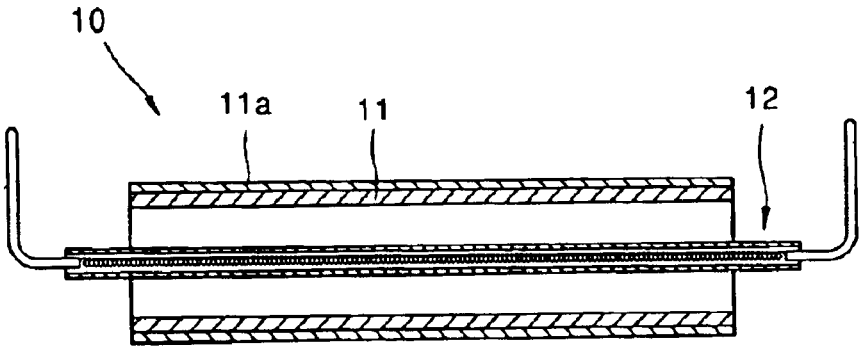
FIG. 1 (PRIOR ART)
FIG. 1 is a cross-sectional view of a conventional fusing roller in which a halogen lamp is installed as a heating source.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Exemplary embodiments of a method of controlling a fusing temperature of an electrophotographic imaging apparatus according to an embodiment of the present invention will be described in detail with reference to the appended drawings. In the drawings, thickness of layers and regions are exaggerated for clarity.

Figure 6:
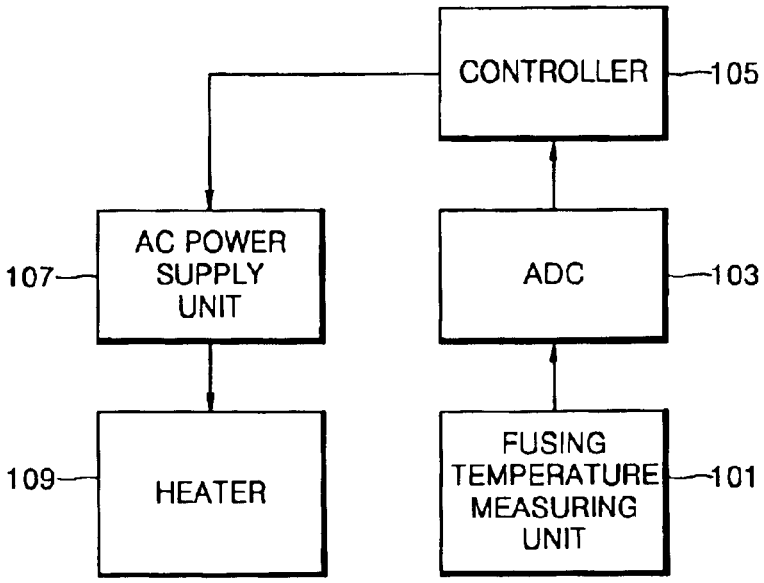
FIG. 6 is a block diagram of a power control apparatus for controlling a fusing temperature of an electrophotographic imaging apparatus according to an embodiment of the present invention.

FIG. 6 is a block diagram of a power control apparatus to control the fusing temperature of the electrophotographic imaging apparatus according to an embodiment of the present invention. A fusing apparatus of FIG. 2 or 4 will be referred to in the following description.

Figure 4:
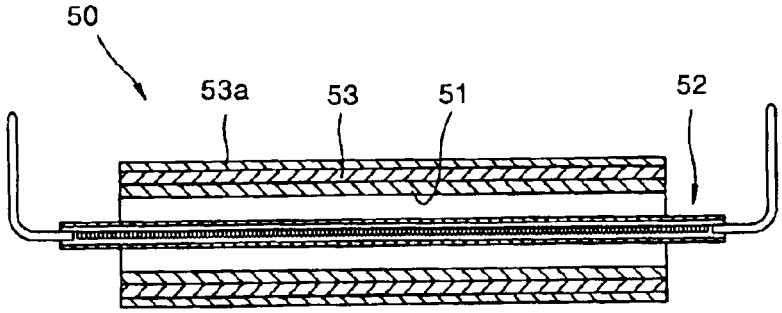
FIG. 4 (PRIOR ART)
FIG. 4 is a cross-sectional view of a fusing roller with a rubber layer between a cylindrical roller and a toner-releasing coating layer.

In the power control apparatus of FIG. 6, a fusing temperature measuring unit 101 measures a surface (fusing) temperature of a fusing roller 50 of FIG. 4 at a predetermined interval of, for example, 100 ms, using a thermal sensor, such as a thermistor 15. An analog value (measured surface temperature) measured by the fusing temperature measuring unit 101 is converted to a digital value by an analog-to-digital converter (ADC) 103 to be input to a controller 105. The controller 105, which performs computations required to control the electrophotographic imaging apparatus, compares the measured surface temperature with a predetermined target fusing temperature and outputs a control signal to an alternating current (AC) power supply unit 107 to control a heater (halogen lamp) 109. The AC power supply unit 107 controls a power supplied to the heater 109 according to the control signal received from the controller 105.

Figure 2:
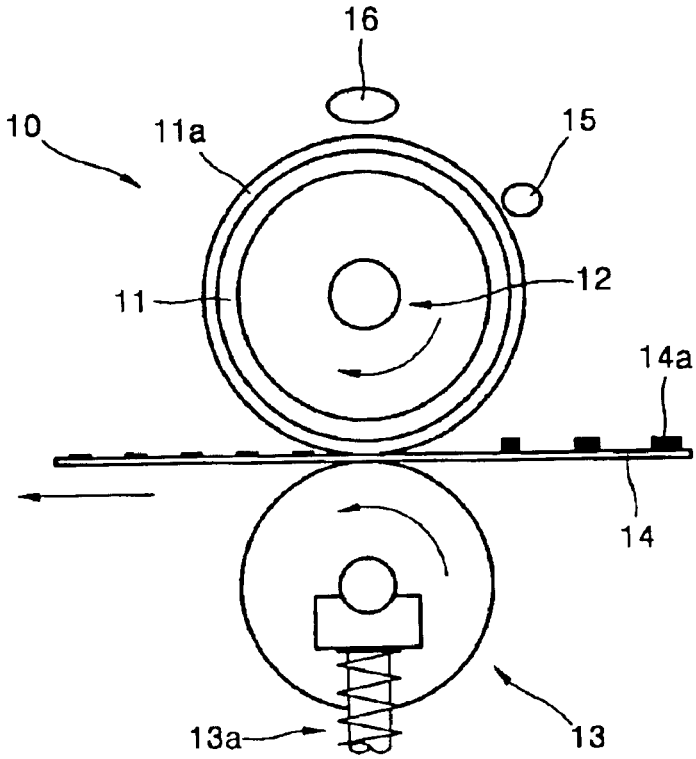
FIG. 2 (PRIOR ART)
FIG. 2 is a cross-sectional view of a fusing apparatus with the fusing roller of FIG. 1.
Figure 3:
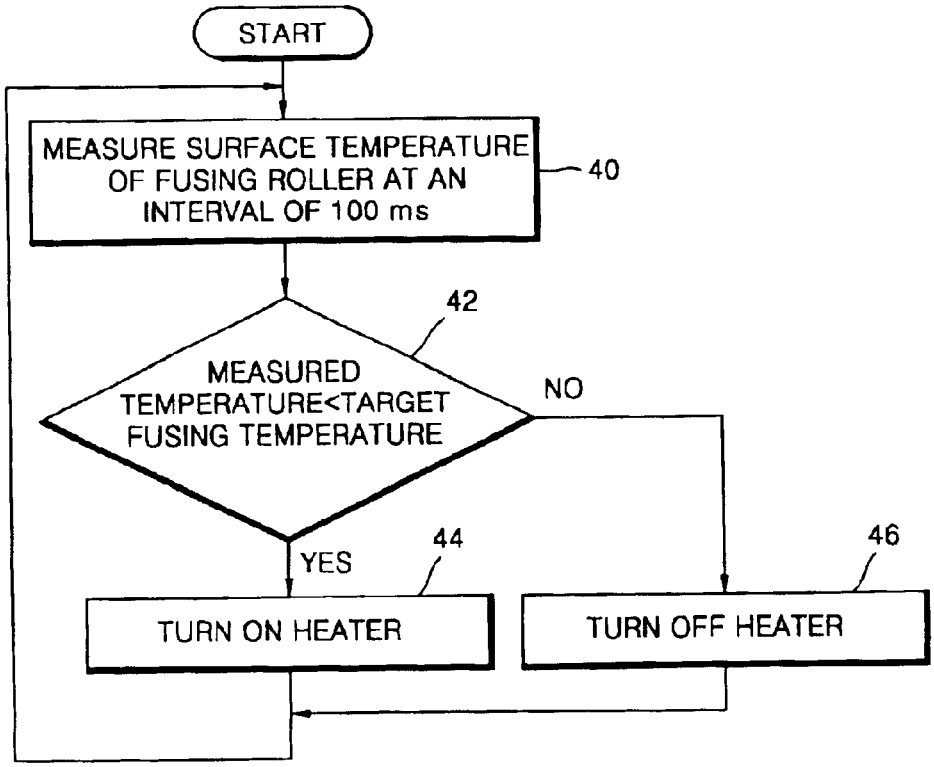
FIG. 3 (PRIOR ART)
FIG. 3 is a flowchart showing an on-off control of the fusing apparatus of FIG. 2 in an electrophotographic imaging apparatus.

The fusing temperature measuring unit 101 and the heater 109 correspond to the thermistor 15 and the halogen lamp 12 or 52 of FIG. 2 or 4, respectively.

Figure 7:
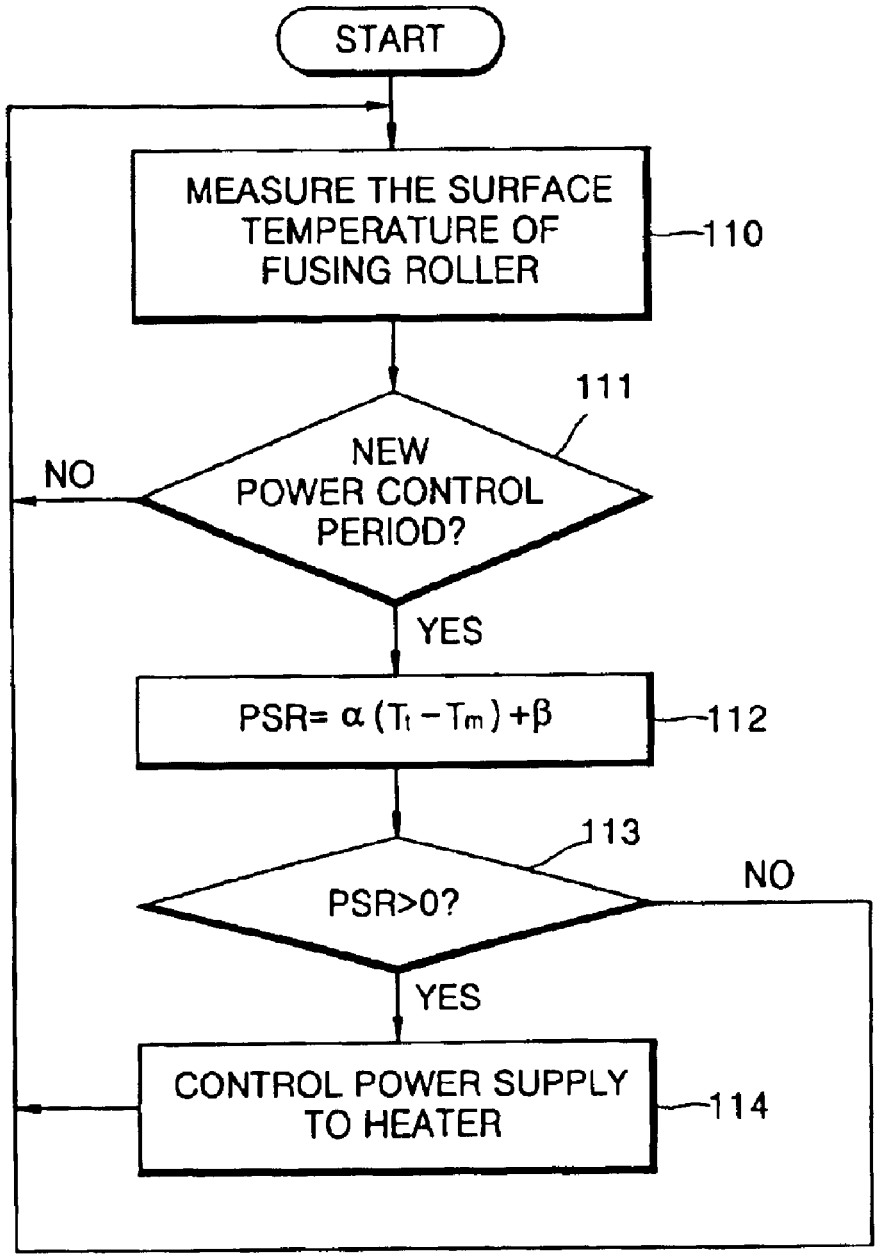
FIG. 7 is a flowchart illustrating a method of controlling a fusing temperature according to another embodiment of the present invention.

FIG. 7 is a flowchart illustrating a method of controlling the fusing (surface) temperature according to an embodiment of the present invention. Referring to FIGS. 4, 6, and 7, the fusing temperature measuring unit 101 measures the surface temperature of the fusing roller 50 at a predetermined interval, for example, of 100 ms, and transmits the measured surface temperature (analog signal) to the ADC 103. The ADC 103 converts the received analog signal into a digital signal and outputs the digital signal to the controller 105 in operation 110.

The controller 105 determines whether a predetermined (previous) power control period, for example, of 30 seconds, has been terminated and whether a new power control period starts in operation 111. If the new power control period does not start yet, the operation 110 is repeated.

If it is determined in operation 111 that the new power control period starts, the controller 105 calculates a power supply ratio (PSR) corresponding to a power to be supplied to the heater 109 for the new power control period in operation 112.

Next, the controller 105 determines whether the calculated PSR is greater than zero in operation 113.

If the power supply ratio (PSR) is determined to be a positive value in operation 113, the controller 105 outputs a control signal to the AC power supply unit 107 to enable the AC power supply unit 107 to supply the power corresponding to the PSR to the heater 105 according to a duty control, which will be described later, in operation 114. When the new power control period is as short as less than a few seconds, the heater 109 may be turned on all the time during the new power control period before a next power control period starts.

If the PSR is determined to be less than or equal to zero in operation 113, the process returns to the operation 110.

Equation (1) below is an exemplary equation to calculate the PSR according to a proportional (P) control. However, the present invention is not limited thereto. Other equations according to a proportional-integral (PI) control, a proportional-integral-derivative (PID) control, etc., can be applied to calculate the PSR.

$$PSR=\alpha(Tt-Tm)+\beta \quad (1)$$

where Tt denotes the target fusing temperature of the fusing roller 50 that varies depending on a type and a thickness of a sheet of paper, the number of paper sheets to be printed, and whether it is color printing or not, and Tm denotes the measured temperature of the fusing roller 50. PSR represents a percentage of the power supplied to the heater 109 for the new power control period with respect to a maximum power that can be supplied to the heater 109, and is a sum of a predetermined offset value β and a control value, which is the product of a subtraction of the measured temperature from the target fusing temperature by a predetermined coefficient α. For example, when 10% of the maximum power is supplied to the heater 109 for the new power control period if the measured temperature is 5° C. lower than the target fusing temperature, and when 15% of the maximum power is supplied to the heater 109 for the new power control period if the measured temperature is 10° C. lower than the target fusing temperature, the coefficient α equals 1, and the offset value β equals 5. The coefficient α is determined by a quality of the paper, a printing speed, whether it is color printing or not, etc. The offset value β is a ratio of the power supplied to the heater 109 during the new power control period with respect to the maximum power that can be supplied to the heater 109 to keep the surface temperature of the fusing roller 50 constant at the target fusing temperature when the surface temperature is maintained at a predetermined level. The power corresponding to the offset value β is supplied to the fusing roller for each control period, which includes a plurality of duty periods (cycles), according to the duty control even after the surface temperature of the fusing apparatus has reached the target fusing temperature, to maintain the surface temperature of the fusing apparatus constant.

If the PSR calculated in operation 112 is lower than zero, the measured temperature of the fusing roller 50 is too high to be compensated by the addition of the offset value β to the control value α(Tt−Tm). Thus, when the measured temperature of the fusing roller 50 is higher than the target fusing temperature by a predetermined amount, the power is not supplied to the heater 109 to prevent the surface temperature of the fusing roller 50 from rising high above the target fusing temperature.

Figure 8:
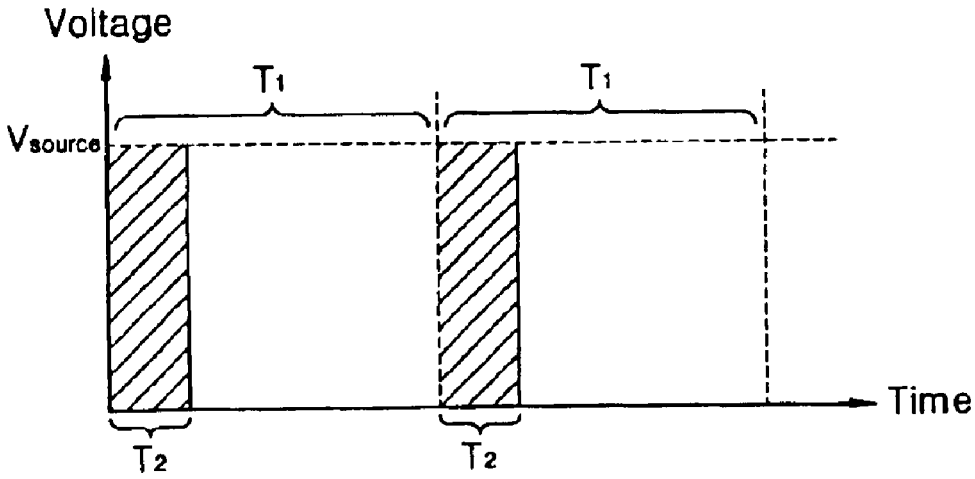
FIG. 8 is a graph explaining a duty control based on an offset value β.

FIG. 8 is a graph explaining the duty control based on the offset value β. The duty control includes turning on the heater 109 only for a sub-period $T_2$ in a main period $T_1$ and turning off the heater 109 for a remaining time of the main period $T_1$.

$$\beta(\%)=T_2/T_1\times 100 \quad (2)$$

The duty control of turning on the heater 109 for the sub-period $T_2$ in each main period to supply just a required amount of the power to the heater 109 is based on a fact that a surface temperature increase of the fusing roller 50 in response to heating is very slow.

The offset value β maintains the surface temperature of the fusing roller 50 at a predetermined target temperature, is determined according to the target fusing temperature of the fusing roller 50, and can be expressed as equation (3) below.

$$\beta=\gamma Tt+\delta \quad (3)$$

where γ and δ are constants.

According to a duty control method, when the fusing apparatus is in a no-load state, the power corresponding to the offset value β is supplied to the heater 109 for a period of time to keep the surface temperature of the fusing apparatus at a predetermined target fusing temperature. In a case that there is a rapid drop in the surface temperature due to some factors, such as an ambient temperature, the drop in the surface temperature is also compensated during the duty control so that the surface temperature can be maintained constant during the duty control. Furthermore, when there is a drop in the surface temperature as a result of a printing operation of the fusing apparatus, in addition to the compensation for the temperature drop through the duty control, the target fusing temperature itself and the offset value β may be raised to maintain the surface temperature constant so that print quality enhancement increases.

Figure 9:
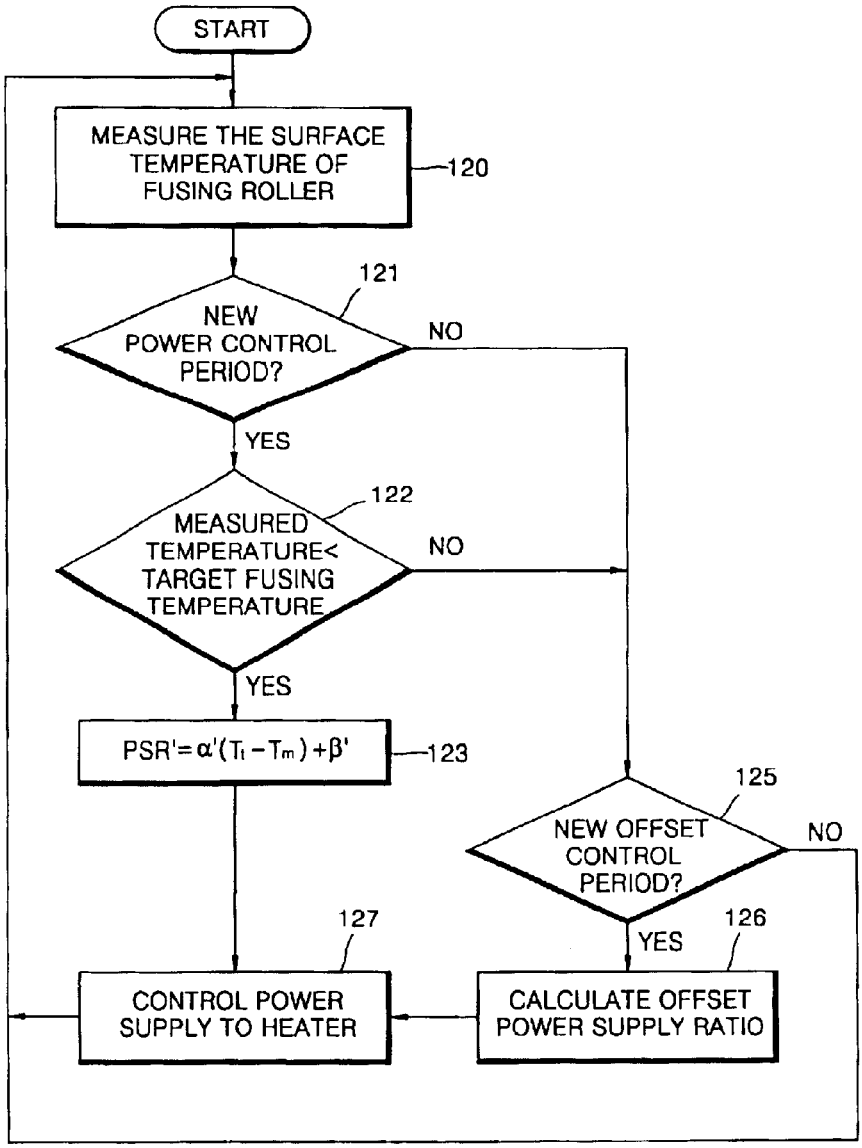
FIG. 9 is a flowchart illustrating a method of controlling a fusing temperature according to another embodiment of the present invention.

FIG. 9 is a flowchart illustrating a method of controlling the fusing temperature according to another embodiment of the present invention. Referring to FIGS. 4, 6, and 9, the fusing temperature measuring unit 101 measures the surface temperature of the fusing roller 50 at the predetermined interval, for example, of 100 ms, and transmits the measured surface temperature (analog signal) to the ADC 103. The ADC 103 converts the received analog signal into the digital signal and outputs the digital signal to the controller 105 in operation 120.

The controller 105 determines whether the predetermined power control period, for example, of 30 seconds, has terminated and the new power control period starts in operation 121. If it is determined that the new power control period starts, it is determined whether the measured temperature is lower than the target fusing temperature in operation 122.

If the measured temperature is determined to be lower than the target fusing temperature, the controller 105 calculates a PSR' using equation (4) in operation 123. Equation (4) below is an exemplary equation to calculate the PSR' according to the P control. However, the present invention is not limited thereto. Other equations according to the PI control, the PID control, etc., can be applied to calculate the PSR'.

$$PSR'=\alpha'(Tt-Tm)+\beta' \quad (4)$$

where Tt denotes the target fusing temperature of the fusing roller 50 that varies depending on the type and the thickness of the paper, the number of paper sheets to be printed, and whether it is color printing or not, and Tm denotes the measured temperature of the fusing roller 50. PSR' represents the percentage of the power supplied to the heater 109 for a predetermined period with respect to the maximum power that can be supplied to the heater 109, and is the sum of a predetermined offset value β' and the control value, which is the product of the subtraction of the measured temperature from the target temperature by a predetermined coefficient α'. The coefficient α' is determined by the quality of the paper, the printing speed, whether it is color printing or not, etc. The offset value β' of equation (4) as a common constant may be the same as the offset value β in equation (1).

Next, the controller 105 controls the power supplied to the heater 109 in operation 127 according to the PSR' calculated in operation 123.

If it is determined in operation 121 that the new power control period does not start yet or if the measured temperature is determined to be greater than or equal to the target fusing temperature in operation 122, it is determined whether a new offset control period starts in operation 125.

If it is determined in operation 125 that the new offset control period starts, an offset power supply ratio (Offset PSR) for the new offset control period is calculated using equation (5) in operation 126. The Offset PSR is determined by the target fusing temperature, as expressed in equation (5) below.

$$\text{Offset } PSR = \epsilon Tt + \zeta \quad (5)$$

where Tt denotes the target fusing temperature of the fusing roller 50 that varies depending on the type and the thickness of the paper, the number of paper sheets to be printed, and whether a printing mode is color printing or not. The Offset PSR is the percentage of the power supplied to the heater 109 for the offset supply period with respect to the maximum power that can be supplied to the heater 109. $\epsilon$ and $\zeta$ are constants determined by a structure of the fusing roller 50, for example, a diameter and a thickness of a cylindrical roller 51, a thicknesses of the rubber layer 53 and a thickness of the toner-releasing coating layer 53*a* (refer to FIG. 4), etc., and the performance of the heater 109.

It is an aspect that the Offset PSR expressed as equation (5) is determined to be smaller than or equal to the power supply ratio with which the power is supplied to the heater 109 for the single new power control period with respect to the maximum power supplied to the heater 109 to keep the fusing (surface) temperature constant when the fusing roller is operated in a no-load state after the surface temperature of the fusing roller 50 reaches the target fusing temperature. A phase control is preferable to control the heater 109 based on the Offset PSR. However, the duty control corresponding to the Offset PSR is also applicable to control the fusing roller 50, which has a rubber layer 53 and is subject to a delayed response to heating.

Next, the heater 109 is controlled to heat the fusing roller 50 for the new power control period in operation 127 according to the power supply ratio PSR' calculated in operation 123 or for the offset control period according to the Offset PSR calculated in operations 26. Next, the process returns to the operation 120.

If it is determined in operation 125 that the new offset control period does not start, the process returns to operation 120.

In the embodiment of the fusing temperature control method according to FIG. 9, as described above, when the new power control period does not start and the new offset control period starts, the power corresponding to the offset power supply ratio is supplied to the heater 109 to maintain the surface temperature constant. In addition, when there is a drop in the surface temperature as a result of the printing operation of the fusing apparatus, the surface temperature can be kept constant by compensating for the drop. In this embodiment, various controls can be achieved by varying the power control period and the offset control period. It is possible that the new power control period is a multiplication of an integer and the offset control period, or the offset control period is a multiplication of an integer and the power control period.

Figure 10:
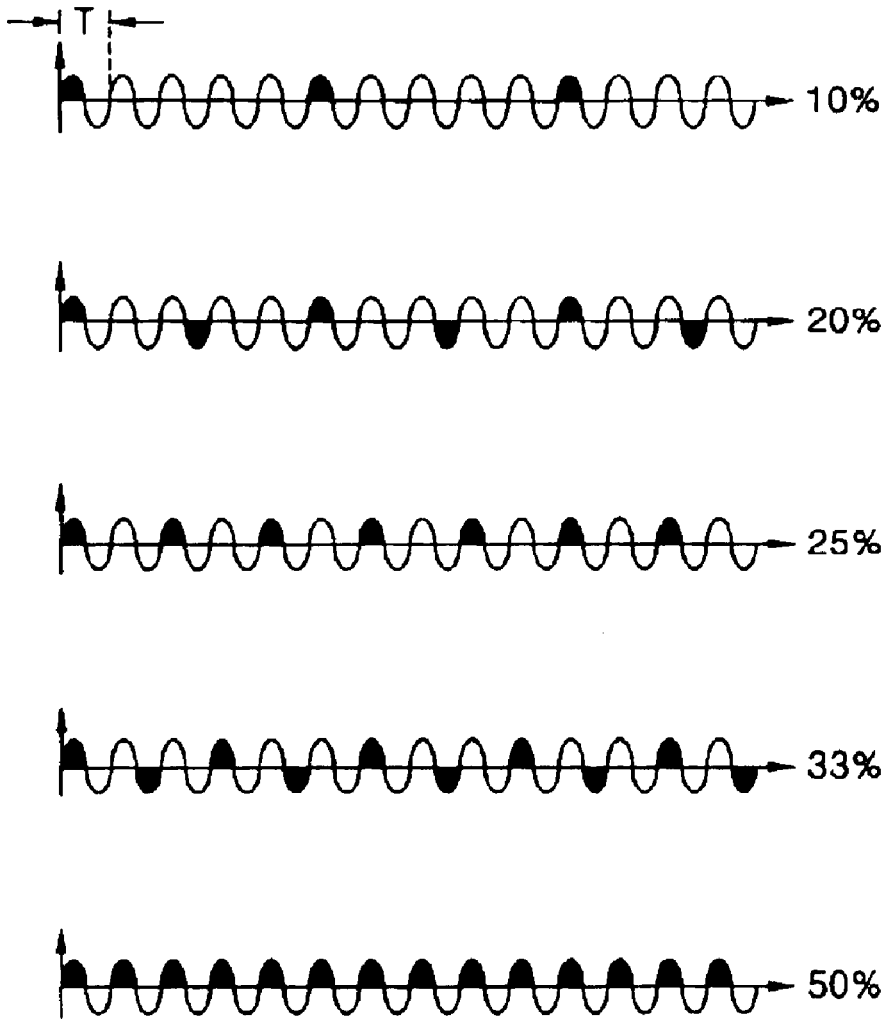
FIG. 10 illustrates a phase control according to power supply ratios.

FIG. 10 shows waveforms of pulse voltages applied to the heater 109 corresponding to 10%, 20%, 25%, 33%, and 50% of a source voltage, respectively. In the waveforms of FIG. 10, dark half waves of a half period (T/2) represent a period of time for which the source voltage is supplied to the heater. As can be inferred from FIG. 10, an equal amount of the power can be supplied periodically to the heater 109 for the new power control period according to the phase control.

Figure 11:
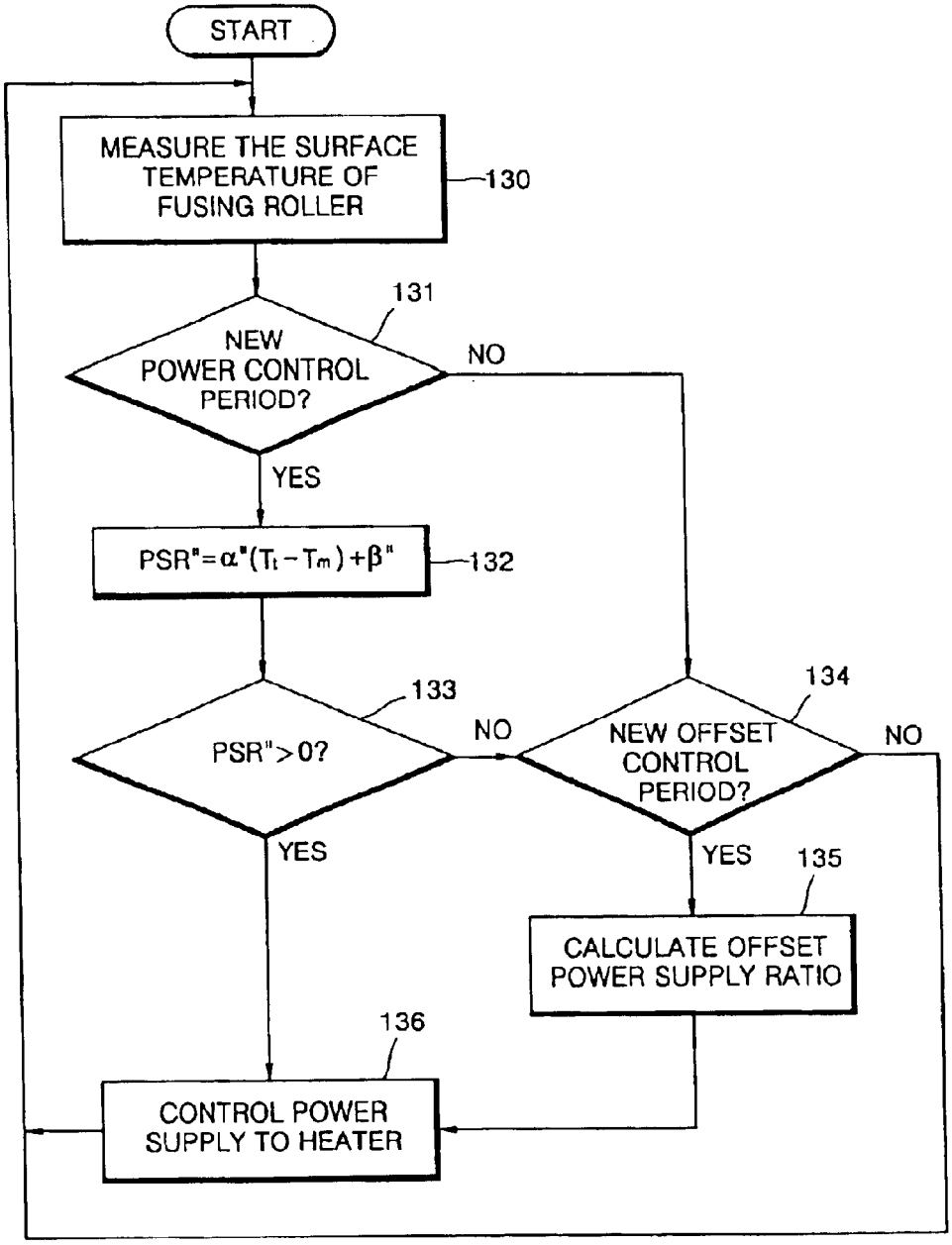
FIG. 11 is a flowchart illustrating a method of controlling a fusing temperature according to another embodiment of the present invention.

FIG. 11 is a flowchart illustrating a method of controlling the fusing temperature according to another embodiment of the present invention. Referring to FIGS. 4, 6, and 11, the fusing temperature measuring unit 101 measures the surface temperature of the fusing roller 50 at a predetermined interval, for example, of 100 ms, and transmits the measured surface temperature (analog signal) to the ADC 103. The ADC 103 converts the received analog signal into the digital signal and outputs the digital signal to the controller 105 in operation 130.

The controller 105 determines whether the power control period, for example, a period of 30 seconds, has terminated and the new power control period starts in operation 131. If it is determined that the new power control period starts, the controller 105 calculates a PSR" using equation (6) below in operation 132. Equation (6) is an exemplary equation used to calculate the PSR" according to the P control. However, the present invention is not limited thereto. Other equations according to the PI control, the PID control, etc., can be applied to calculate the PSR".

$$PSR'' = \alpha''(Tt - Tm) + \beta'' \quad (6)$$

where Tt denotes the target fusing temperature of the fusing roller 50 that varies depending on the type and the thickness of the paper, the number of paper sheets to be printed, and whether it is color printing or not, and Tm denotes the measured surface temperature of the fusing roller 50. PSR" represents the percentage of the power supplied to the heater 109 for the new power control period with respect to the maximum power that can be supplied to the heater 109. $\alpha''$ is a coefficient used to compensate for a difference between the target fusing temperature and the measured temperature, and $\beta''$ is a common constant.

Next, it is determined whether the power supply ratio PSR" calculated in operation 132 is greater than zero in operation 133. If the power supply ratio PSR" is determined to be a positive value in operation 133, the heater 109 is controlled to heat the fusing roller 50 for the new power control period in operation 136 according to the power supply ratio PSR" calculated in operation 132.

If it is determined in operation 131 that the new power control period does not start yet or if the power supply ratio PSR" is determined to be less than or equal to zero in operation 133, it is determined whether the new offset control period starts in operation 134.

If it is determined in operation 134 that the new offset control period starts, an offset power supply ratio (Offset PSR') for the new offset control period is calculated using equation (7) below in operation 135. The Offset PSR' is determined by the target fusing temperature, as expressed in equation (7) below.

$$\text{Offset } PSR' = \epsilon' Tt + \zeta' \quad (7)$$

where $\epsilon'$ and $\zeta'$ are constants determined by the structure of the fusing roller 50, for example, the diameter and the thickness of the cylindrical roller 51, the thicknesses of the rubber layer 53, the thickness of the toner-releasing coating layer 53*a* (refer to FIG. 4), etc., and the performance of the heater 109.

It is possible that the Offset PSR expressed as equation (7) is determined to be smaller than or equal to the power supply ratio with which the power is supplied for the single new power control period with respect to the maximum power supply to the heater 109 to keep the fusing temperature constant when the fusing roller 50 is operated in the no-load state after the surface temperature of the fusing roller 50 reaches the target fusing temperature. The phase control is used to control the heater 109 based on the Offset PSR.

However, the duty control corresponding to the Offset PSR is also applicable to control the fusing roller 50 which has the rubber layer 53 and is subject to the delayed response to heating.

Next, the heater 109 is controlled to heat the fusing roller 50 for the power control period in operation 136 according to the power supply ratio PSR" calculated in operation 132 or for the offset control period according to the Offset PSR' calculated in operation 135. Next, the process returns to operation 130.

If it is determined in operation 134 that the new offset control period does not start yet, the process returns to the operation 130.

In the fusing temperature control method according to the present embodiment, when the new power control period does not start and the new offset control period starts, the power corresponding to the offset power supply ratio is supplied to the heater 109 to maintain the surface temperature constant. In addition, when there is a drop in the surface temperature as a result of the printing operation of the fusing apparatus, the surface temperature can be kept constant by compensating for the drop.

The present embodiment shown in FIG. 11 is substantially the same as the embodiment of FIG. 9, except that the heater 109 is controlled according to the power supply ratio PSR" as far as the power supply ratio PSR" calculated in operation 132 is the positive value in operation 133 even when the measured temperature of the fusing roller 30 is greater than the target fusing temperature.

Figure 12:
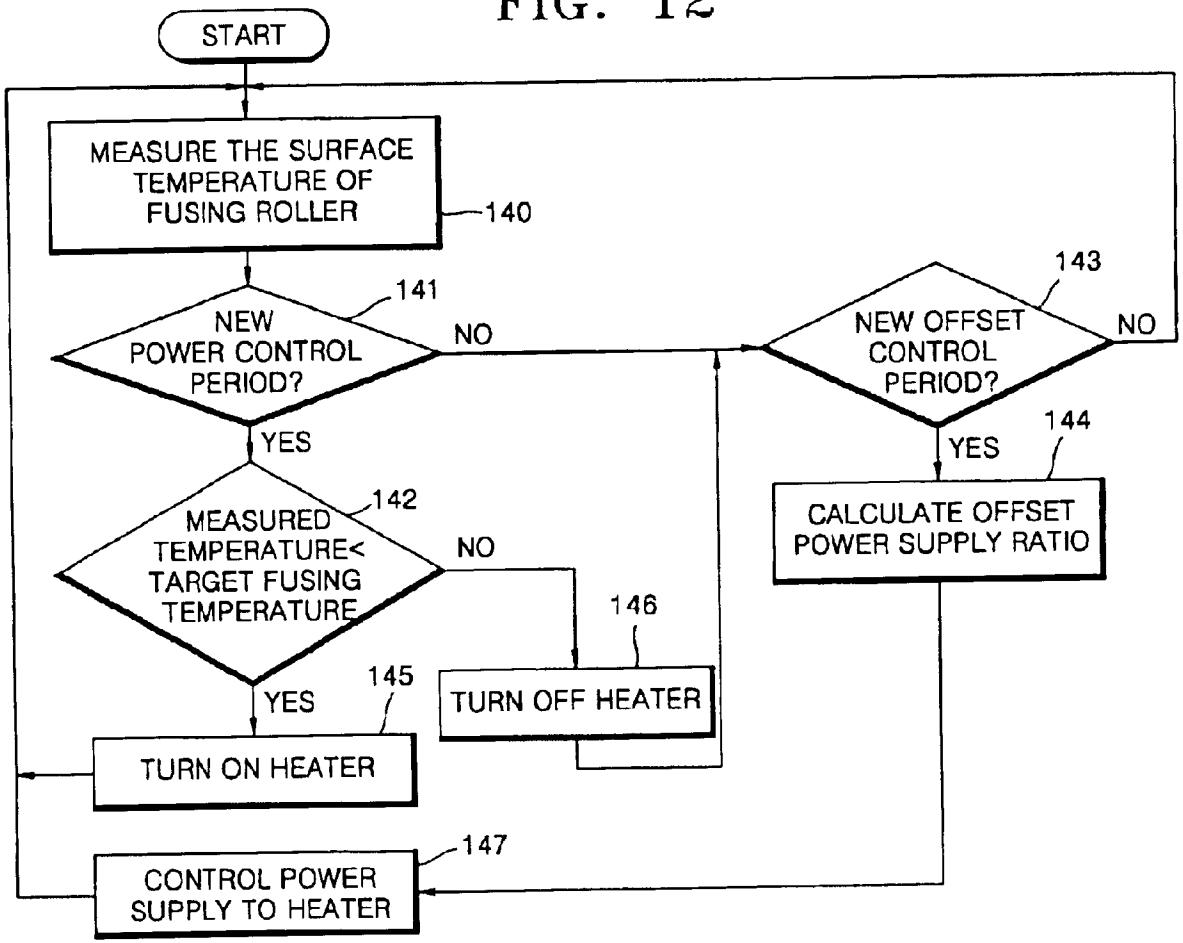
FIG. 12 is a flowchart illustrating a method of controlling a fusing temperature according to another embodiment of the present invention.

FIG. 12 is a flowchart illustrating a method of controlling the fusing temperature according to another embodiment of the present invention. Referring to FIGS. 4, 6, and 12, the fusing temperature measuring unit 101 measures the surface temperature of the fusing roller 50 at a predetermined interval, for example, of 100 ms, and transmits the measured surface temperature (analog signal) to the ADC 103. The ADC 103 converts the received analog signal to a digital signal and outputs the digital signal to the controller 105 in operation 140.

The controller 105 determines whether the predetermined power control period, for example, a period of 1–2 seconds, has terminated and the new power control period starts in operation 141. If it is determined that the new power control period starts, it is determined whether the measured temperature is lower than the target fusing temperature in operation 142.

If the measured temperature is determined to be lower than the target fusing temperature, the heater 109 is turned on during the new power control period in operation 145, and the process returns to the operation 140.

If the measured temperature is determined to be greater than or equal to the target fusing temperature, the heater 109 is turned off in operation 146), and the process goes to the operation 143.

If it is determined in operation 141 that the new power control period does not start yet after the surface temperature of the fusing roller 50 has been measured or after the heater 109 is turned off in operation 146, it is determined whether the new offset control period starts in operation 143.

Figure 5:
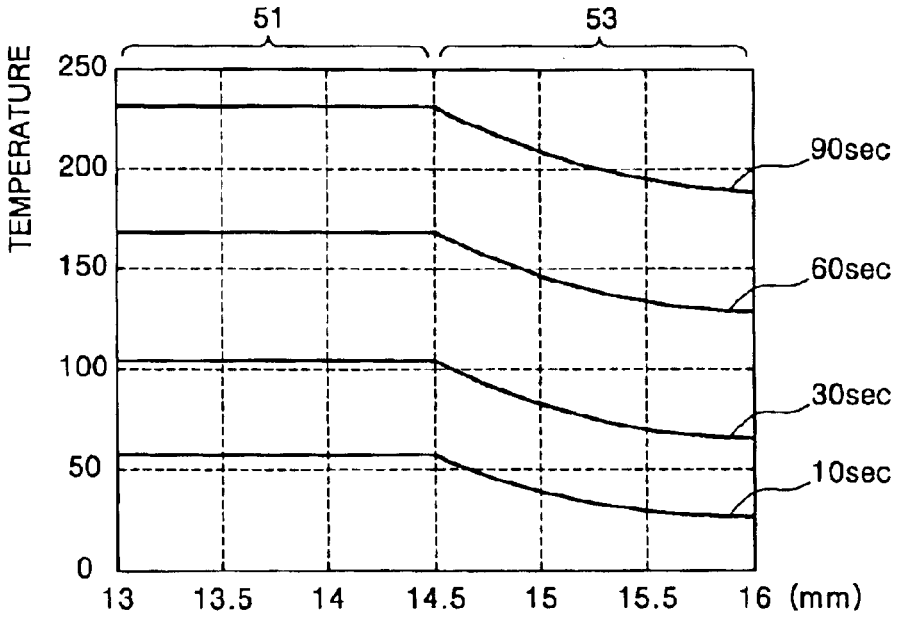
FIG. 5 (PRIOR ART)
FIG. 5 is a graph of temperature profiles with respect to time at various positions in a radial direction of the fusing roller of FIG. 4 when a predetermined power is applied to a heater of the fusing roller.

If it is determined in operation 143 that the new offset control period starts, the offset power supply ratio, Offset PSR, for the new offset control period is calculated using equation (5) illustrated supra. The offset power supply ratio used in this embodiment is substantially the same as the Offset PSR of FIG. 5, and thus a detailed description thereon is omitted.

Next, the heater 109 is controlled to heat the fusing roller 50 for the offset control period according to the Offset PSR in operation 147. Next, the process returns to the operation 140.

If it is determined in operation 143 that the new offset control period does not start, the process returns to operation 140.

In the fusing temperature control method according to the present embodiment, the surface temperature of the fusing roller 50 is controlled by the on-off control when the new power control period starts. When the new power control period does not start yet or when the new power control period starts and the heater 109 turned off due to the measured temperature of the fusing roller 50 that is greater than the target fusing temperature, the above-described offset control is performed to keep the temperature of the fusing roller constant.

The fusing temperature control methods described in the above embodiments may be used individually or in combination depending on the printing circumstances. For example, the fusing temperature control method according to the embodiment of FIG. 7 may be applied in a print standby mode. The fusing temperature control method according to the embodiment of FIG. 9 may be applied for a slower color printing mode. The fusing temperature control method according to the embodiment of FIG. 12 may be applied for a relatively speedy monochromic printing mode.

As described above, in the method of controlling the fusing temperature of the electrophotographic imaging apparatus according to the embodiments of the present invention, a thermal loss during a print mode is compensated by conventional power control methods, and the thermal loss in the fusing apparatus in the no-load state is compensated by periodically supplying the power to the heater, so that the fusing temperature is maintained nearly constant, and a quality of images fused onto a recording medium is improved.

In addition, according to the present invention, since the power control is performed for a predetermined cycle that is longer than usual, ranging from a few to tens of seconds, there is no serious flicker problem.

While the present invention has been particularly shown and described with reference to exemplary embodiments thereof, it will be understood by those of ordinary skill in the art that various changes in form and details may be made therein without departing from the spirit and scope of the present invention as defined by the following claims and their equivalents.

What is claimed is:

1. A method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising:

determining whether a predetermined new power control period starts;

upon determining that the new power control period starts, calculating a power supply ratio corresponding to a power to be supplied to the heater during the new power control period with respect to a maximum power that can be supplied to the heater;

upon determining that the calculated power supply ratio is greater than zero, supplying the power to the heater during the new power control period according to the power supply ratio; and upon determining that the calculated power supply ratio is not greater than zero, repeating the operations of determining whether the predetermined power control period starts, calculating the power supply ratio, and supplying the power to the heater, wherein the power supply ratio is calculated by adding a predetermined offset value β to a control value that is a product of a predetermined coefficient α and a subtraction of a measured temperature of the fusing roller from a target fusing temperature, and the offset value β is smaller than or equal to a ratio of a power supply with respect to the maximum power supplied to the heater for the new power control period to maintain the measured temperature of the fusing roller at the target fusing temperature when the fusing temperature is around the target fusing temperature.

2. The method of claim 1, wherein the offset value β is determined according to the target fusing temperature of the fusing roller.

3. The method of claim 1, wherein the coefficient α is determined according to at least one of a quality of a sheet of paper, a printing speed, and whether a printing mode is color printing.

4. The method of claim 1, wherein the supplying of the power corresponding to the power supply ratio to the heater during the new power control period comprises:

supplying the power to the heater according to a duty control.

5. The method of claim 1, wherein the supplying of the power corresponding to the power supply ratio to the heater for the new power control period comprises:

supplying the power to the heater according to an on-off control.

6. A method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising:

determining whether a predetermined new power control period starts;

upon determining that the new power control period starts, determining whether a measured temperature of the fusing roller is lower than a target fusing temperature;

upon determining that the measured temperature is lower than the target fusing temperature, calculating a power supply ratio corresponding to a power to be supplied to the heater during the new power control period with respect to a maximum power that can be supplied to the heater;

supplying the power corresponding to the power supply ratio to the heater during the new power control period;

upon determining that the new control period does not start yet or if the measured temperature is not lower than the target fusing temperature, determining whether a predetermined new offset control period starts; and upon determining that the new offset control period starts, calculating an offset power supply ratio corresponding to the power to be supplied to the heater during the new offset control period, and supplying the power corresponding to the calculated offset power supply ratio to the heater.

7. The method of claim 6, wherein the power supply ratio is calculated by adding a predetermined offset value β to a control value that is a product of a predetermined coefficient α and a subtraction of the measured temperature from the target fusing temperature.

8. The method of claim 6, wherein the offset power supply ratio is smaller than or equal to a ratio of power supply with respect to the maximum power that is supplied to the heater for the new power control period to maintain the measured temperature of the fusing roller at the target fusing temperature when the measured temperature reaches the target fusing temperature.

9. The method of claim 6, wherein the offset power supply ratio is determined according to the target fusing temperature of the fusing roller.

10. The method of claim 6, wherein the predetermined coefficient α is determined according to at least one of a quality of a sheet of paper, a printing speed, and whether a printing mode is color printing.

11. The method of claim 6, wherein the power corresponding to the offset power supply ratio is supplied to the heater according to a duty control during the offset control period.

12. The method of claim 6, wherein the power corresponding to the offset power supply ratio is supplied to the heater according to a phase control during the offset control period.

13. A method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising:

determining whether a predetermined new power control period starts;

upon determining that the new power control period starts, calculating a power supply ratio corresponding to a power to be supplied to the heater during the new power control period with respect to a maximum power that can be supplied to the heater;

determining whether the calculated power supply ratio is greater than zero;

upon determining that the calculated power supply ratio is greater than zero, supplying the power corresponding to the power supply ratio to the heater during the new power control period;

upon determining that the new power control period does not start yet or if the calculated power supply ratio is smaller than or equal to zero, determining whether a predetermined new offset control period starts; and upon determining that the new offset control period starts, calculating an offset power supply ratio corresponding to the power to be supplied to the heater during the new offset control period and supplying the power corresponding to the calculated offset power supply ratio to the heater.

14. The method of claim 13, wherein the power supply ratio is calculated by adding a predetermined offset value β to a control value that is a product of a predetermined coefficient α and a subtraction of a measured temperature from a target fusing temperature.

15. The method of claim 13, wherein the offset power supply ratio is smaller than or equal to a ratio of the power supply with respect to the maximum power that is supplied to the heater for the new power control period to maintain a temperature of the fusing roller at a target fusing temperature when the temperature of the fusing roller reaches the target fusing temperature.

16. The method of claim 13, wherein the offset power supply ratio is determined according to a target fusing temperature of the fusing roller.

17. The method of claim 13, wherein the predetermined coefficient α is determined according to at least one of a quality of a sheet of paper, a printing speed, and whether a printing mode is color printing.

18. The method of claim 13, wherein the power corresponding to the offset power supply ratio is supplied to the heater according to a duty control during the offset control period.

19. The method of claim 13, wherein the power corresponding to the offset power supply ratio is supplied to the heater according to a phase control during the offset control period.

20. A method of controlling a fusing temperature of a fusing roller in an electrophotographic imaging apparatus, the fusing roller having a cylindrical roller, a heater heating the cylindrical roller, and a rubber layer formed on a surface of the cylindrical roller with a predetermined thickness, the method comprising:

determining whether a predetermined new power control period starts;

upon determining that the new power control periodstarts, determining whether a measured temperature of the fusing roller is lower than a target fusing temperature;

turning on the heater during the new power control period if the measured temperature is lower than the target fusing temperature, and turning off the heater during the new power control period if the measured temperature is greater than or equal to the target fusing temperature;

upon determining that the new power control period does not start yet, determining whether a predetermined new offset control period starts; and upon determining that the new offset control period starts, calculating an offset power supply ratio corresponding to a power to be supplied to the heater during the new offset control period and supplying the power corresponding to the calculated offset power supply ratio to the heater.

21. The method of claim 20, wherein upon determining that the new power control period does not start yet or if the heater has been turned off, it is determined whether the predetermined new offset control period starts.

22. The method of claim 20, wherein the offset power supply ratio is smaller than or equal to a ratio of a power supply with respect to the maximum power that is supplied to the heater for the new power control period to maintain the measured temperature of the fusing roller at the target fusing temperature when the measured temperature of the fusing roller reaches the target fusing temperature.

* * * * *